United States Patent [19]

Gifford, II

[11] 4,094,767

[45] June 13, 1978

[54] FLUIDIZED BED RETORTING OF TAR SANDS

[75] Inventor: Phillip H. Gifford, II, Carbondale, Colo.

[73] Assignee: Phillips Petroleum Company, Bartlesville, Okla.

[21] Appl. No.: 740,525

[22] Filed: Nov. 10, 1976

[51] Int. Cl.[2] ..... C10G 1/02

[52] U.S. Cl. ..... 208/11 R; 201/14; 201/29; 201/31; 201/38

[58] Field of Search ..... 208/11 R; 201/14, 29, 201/31, 38

[56] References Cited

U.S. PATENT DOCUMENTS

| | | | |
|---|---|---|---|
| 2,582,712 | 1/1952 | Howard | 208/11 R |
| 2,719,112 | 9/1955 | Kearby et al. | 201/38 |
| 2,844,886 | 7/1958 | Nathan | 208/11 R |
| 3,261,775 | 7/1966 | Blaser | 208/11 R |
| 3,501,394 | 3/1970 | Lyons | 208/11 R |
| 3,577,338 | 5/1971 | Gifford | 201/38 |
| 3,617,468 | 11/1971 | Reyburn et al. | 208/11 R |
| 4,001,105 | 1/1977 | Gifford | 208/11 R |

*Primary Examiner*—Delbert E. Gantz
*Assistant Examiner*—James W. Hellwege

[57] ABSTRACT

Raw tar sand is treated in a fluidized bed reactor means wherein the raw tar sands are fed into an area below the top of the bed. The bitumen is converted in the process in a reducing atmosphere including steam to produce hot coked sand and hot off-gases. Off-gases from the reactor means pass through a heat exchanger means to preheat fresh (raw) tar sand. The cooled off-gases are separated to recover raw oil, while at least a portion of the separated gases are recycled to the reactor means, to retrieve and retain heat in the system by passing upwardly through hot spent sand. Steam and oxygen are injected into the lower area of the fluid bed in an area above the spent sand zone to burn off coked sand so as to produce heat for the cracking zone.

10 Claims, 2 Drawing Figures

FLUIDIZED BED RETORTING OF TAR SANDS

FIELD OF THE INVENTION

The invention relates to a method of processing raw tar sands.

BACKGROUND OF THE INVENTION

Tar sands, also known as oil sands or bituminous sands, are sand deposits impregnated with a dense, viscous petroleum-like material generally termed bitumen. Tar sands are found throughout the world, though the largest known deposits lie in the province of Alberta, Canada, and in Eastern Venezuela, though deposits in the lower continental United States are sizable.

Tar sands have interesting — and enticing — properties in that the bitumen can be separated from the sand by a variety of methods, including in situ including thermal, emulsion-steam drive, and even atomic explosion; mining followed by processing of various types such as direct coking, anhydrous solvent extraction, cold water separation, hot water separation, and the like; and any of these followed by possibly various methods of upgrading of the separated bitumen to a more salable product generally described as synthetic crude oil.

Despite the fact that the existence of the tar sand deposits and that the bitumen can be separated have been known for years, nevertheless, as a matter of fact, separating the bitumen on a practical, economical basis has so far pretty much escaped a good solution.

The ruins of various tar sand ventures are legion, generally sunk in the mire of the huge quantity of total material to be handled to try to recover some of the bitumen, and, in a sense, burned out by the overconsumption of fuel to provide heat for the recovery process, which heat all too often has been generally lost out of the process without adequate retention or recycle to make a commercially economically viable process.

The tar sand, or possibly more properly bituminous sand, comprises a mixture of sand, water, and bitumen. The sand component typically is predominantly a quartz wetted with connate water, or oil, or both, and partially filling or surrounding the wetted particles is a film of bitumen in the sand voids. This material has a composition that is variable, but typically contains about 83 weight percent sand, the balance being water and bitumen. There are wide variations in the bitumen content from virtually nothing to upwards of 17 weight percent. Again, the big problem is the huge weight of raw material which must be processed in order to recover the bitumen, compounded by the loss — or rather consumption — of bitumen or of the recovered hydrocarbon products in providing heat for the recovery of further bitumen. The situation is compounded by heat losses from such processing system through outflow of heat with product streams and/or spent sand streams.

Needed to have a viable tar sand recovery process is a method that is thermally efficient.

SUMMARY OF THE INVENTION

According to my process, fresh (raw) tar sands are preheated and injected into the fluidized bed of a tar sand reactor means into an area of the fluidized bed below the top of the bed. The bitumen contained in the fresh tar sand input stream is reacted under substantially reducing conditions in the presence of steam, recycle gases, and combustion gases, such that the bitumen is converted to vaporous hydrocarbonaceous materials to some extent by vaporization and at least to some extent by cracking in the process, leaving a coked sand. Hot gases are removed overhead from the fluidized bed and passed in heat exchange with fresh tar sands, or with air which is thus preheated air and then is used in heat exchange with fresh tar sand, prior to adding the thus preheated tar sands into the fluidized bed. The partially cooled off-gases are separated to recover a raw oil as product, while the separated gases are recycled at least in part to the base area or heat recovery zone of the reactor means. The recycle gases are passed upwardly through the downwardly moving bed of hot spent sand, thus returning heat into the reactor decoking and cracking zones. Steam and oxygen are injected into the fluidized bed in the decoking area above the spent sand cooling zone, and below the input area in the cracking zone for fresh tar sand.

Thermal efficiency is obtained in my process from the incoming recycle off-gas which in turn recovers heat from the spent sand which would otherwise escape from the system. The hot recycle gases, combustion products from decoking, and steam provide a substantially reducing atmosphere for the conversion of bitumen to vaporous products. These reducing conditions are believed to be advantageous in permitting recovery of more of the bitumen as useful products than is otherwise possible.

DETAILED DESCRIPTION OF THE INVENTION

Figure 1:
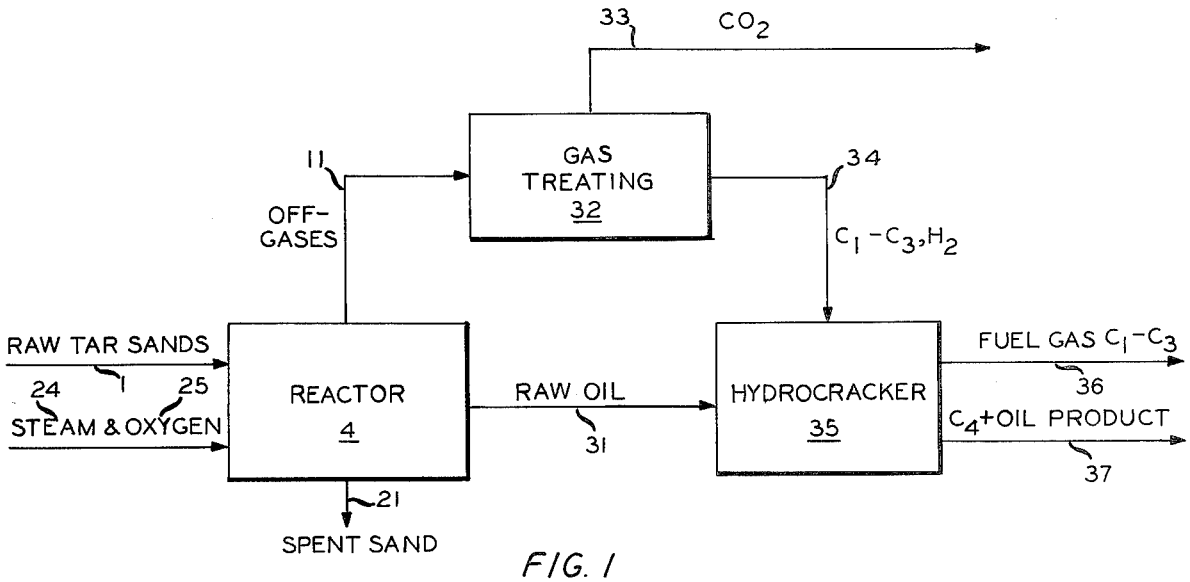
FIG. 1 is a block diagram of the overall process, showing input of raw tar sands 1, steam 24, and oxygen 25, into the reactor means 4. From the reactor means 4 flow the overhead off-gases 11 to a gas purification plant 32. A portion of the overhead off-gases are recycled (not shown) to the reactor. The gas purification/-separation plant 32 provides an off flow of carbon dioxide 33, and a stream 34 comprising hydrogen and lower hydrocarbons of about $C_1$–$C_3$ character. Spent (decoked and cooled) sand 21 is, of course, removed from the reactor means 4, and this spent sand is substantially cooled by the recycle gases. The reactor means 4 produces a stream of what may be termed raw oil 31 which preferably is treated in a hydrocracker 35, employing hydrogen 34 from the gas purification plant 32. From the hydrocracker 35 is obtained a stream of fuel gas 36 of valuable BTU content, primarily of $C_1$–$C_3$ hydrocabons, and an oil product stream 37 which is or can be termed a synthetic crude, and is of a generally $C_4$+ character.

In accordance with the process of my invention, raw tar sand 1 is preheated in a preheater 2 by an indirect heat exchange and fed 3 into the generally central area of a fluidized bed reactor means 4. This fluidized bed reactor means 4 contains a fluidized bed of spent sand wherein the bitumens in the raw tar sands are thermally decomposed to lower molecular weight products.

The reactor means or fluidized bed means comprises several sections or zones positioned generally vertically: (*a*) disengagement zone 8, (*b*) conversion or cracking zone 5, (*c*) decoking zone 6, (*d*) a lower heat recovery zone 7 to recover heat from the spent sand in the moving bed.

The tar sands containing bitumen are fed 3 to the central conversion or cracking zone area of the fluidized bed reactor 4. In the cracking zone 5, the bitumen is subjected to a reducing environment of heat, steam, hot recycle gases, and combustion gases from the decoking zone, as well as possibly some catalytic effects from the sand itself. In the cracking zone 5 the bitumen on the tar sands is partially vaporized and at least partially cracked in this reducing environment. The vaporous off gases of hydrocarbonaceous materials, steam, and combustion and recycle gases, are passed upwardly through a disengaging zone 8, preferably via a cyclone 9 so as to separate out fines and the like, and removed 11.

The hot vaporous off-gases 11 are shown passing in indirect heat exchange 2 with fresh tar sands so as to preheat the stream of tar sand prior to input 3 into the fluid bed 4. This step helps conserve heat in the system. Avoidance of escape of heat from the reactor in so far as possible is important for economical operation. An alternative mode, not shown, is to pass the off-gases 11 in indirect heat exchange with an air stream (not shown) to produce a stream of hot air. This thus-heated air stream can be used to preheat the incoming tar sand by a separate indirect heat exchange (not shown). The then cooled air can be exhausted or recycled to recontact with the hot off gases. This mode of using an air stream may be advantageous in some modes of construction. These heat conservation methods provide means of heat conservation and heat recovery from the fluidized bed reactor, since much heat which would otherwise be lost is returned into the incoming tar sand feed stream.

The now at least partially cooled off-gas stream 12 preferably is subjected to a separation step, such as in a cyclone 13, so as to remove large diameter mist particles 14 of oily materials. The gaseous discharge 15 can be treated, if desired, in a further separation step such as an electrostatic precipitator ESP 16 to remove small diameter mist particles 17, leaving primarily separated off-gases 18. The separated demisted off-gases 18 comprise steam, and low molecular weight hydrocarbonaceous material substantially free of heavier oily components, together with hydrogen, carbon dioxide, and carbon monoxide. At least a portion of this now cooled separated off-gas 18 is recycled 19 to the lower area heat recovery zone 7 of the moving bed reactor means 4. These recycle gases 19 are input into and through the moving bed 7 of spent sand, thereby taking heat from the spent sand and returning said heat by means of the now reheated recycle gas back through the decoking zone 6 on into the cracking zone 5. The now substantially cooled spent sand 21 is removed for disposal. The remainder of the produced gases 23 are treated for consumption or disposal as discussed hereinbelow.

Into the decoking zone 6 of the fluidized bed reactor 4 are supplied steam 24 and molecular oxygen 25. The steam 24 and oxygen 25 are shown in the drawing as a single line for simplicity but in practice generally would be separate. In the decoking zone 6, the coked sand resulting from the treatment of the bitumen in the conversion zone 5 is substantially burned off, resulting in a hot decoked sand, thus recovering the heating value of said coke and thus producing very needed heat for the bitumen conversion process in the conversion zone 5. This heat flows upwardly with the gases and fluidized hot sand into cracking zone 5. The decoked hot sand passes downwardly and is contacted intimately 7 in countercurrent fashion with the cooled separated recycled gases 19. The cooled sand output 21 from the reactor means is a relatively decoked spent cooled sand which then is conveyed for disposal.

The produced gases 23 not needed for recycle 19 can be cooled 26 and separated 27 to recover a dry off-gas 28, remove a stream of sour water 29 from the system, and recover any remaining heavies 30. This sour water 29 can be evaporated for production of additional steam if desired, and to minimize water disposal.

The dry produced gas 28 comprises hydrogen, carbon dioxide, carbon monoxide, and $C_1$–$C_3$ hydrocarbons. The dry produced gas 28 can be conveyed to a gas purification means 32 wherein the carbon monoxide can be subjected to a shift reaction; the carbon dioxide recovered 33; and the product hydrogen 34 and $C_1$–$C_3$ hydrocarbons 34 recovered and fed to a hydrocracking plant 35.

Carbon dioxide can be removed by scrubbing with an amine, such as diethanolamine, or with one of the many glycols such as polyethylene glycol dimethylether such as described in U.S. Pat. No. 3,362,133, leaving a stream of $C_1$ to $C_3$ hydrocarbons and hydrogen 34 for feed to the hydrocracker.

The hydrogen and $C_1$–$C_3$ hydrocarbons alternatively or in part may be used without additional treatment as fuel gases as needed. If separation into the individual members is desired, a cryogenic liquefaction process followed by fractionation may be used. The gas stream can be cooled and largely liquefied by refrigeration and expansion. Hydrogen is separated as non-liquefied gas. The liquefied $C_1$–$C_3$ hydrocarbons can be then fractionated such as described in U.S. Pat. No. 3,292,381.

The raw oil recovered in the various steps, 14 from the cyclone, 12 from the precipitator, and 30 from separation, are combined 31. While this raw oil itself may be sent out for use as a hydrocarbon source, it is preferable to treat it in a hydrocracker 35, particularly since my process provides a source of hydrogen. The hydrogen employed in the hydrocracker reacts with the raw oil 31 so as to produce ultimately a $C_1$–$C_3$ fuel gas 36, and a valuable upgraded $C_4$+ synthetic crude oil 37 for further general refinery treatment or use. The fraction 34 is shown passing through the hydrocracker 35, but could be passed around and then combined with the additional $C_1$–$C_3$ produced in the hydrocracking step if the hydrogen were separated out as described above.

My approach comprises a fluid bed-moving bed reactor wherein the raw tar sands are fed at a point below the surface of the fluidized bed. My approach avoids many of the problems encountered with thermal degradation of the bitumen by prior art processes which drop the raw tar sand onto the top of the hot fluidized sand bed wherein the temperatures are maximum.

Thus, the raw tar sand with the bitumen in my process is fed into approximately the fluidized portion of the reactor means but well above the point where the steam and oxygen are fed. As the bitumen is converted, partially by vaporization, partially by cracking, the hot separated vaporous material flows upwardly and outwardly. The fluidized bed of now coked hot sand flows generally downwardly. Steam and oxygen are used as the retorting medium, fed into the decoking zone below the cracking zone. Reaction of the oxygen with the coke on the hot coked sand provides a necessary supply of thermal energy, heat, which flows upwardly into the conversion zone so as to effectively remove the bitumen from the hot tar sand input. The oxygen reacting with the coke, together with the steam, provide a suitable, effective, generally reducing atmosphere in which to crack the heavy thermal decomposition products of the bitumen. The oxygen substantially reacts almost instantaneously with either the coke which is deposited on the sand, or any combustible materials recycled via the recycle gases, such as hydrogen, or both. Thus, the upwardly rising and produced hot gases retort fresh bitumen under reducing conditions rather than oxidizing conditions, recovering more of the bitumen as a usable product than would be otherwise obtainable. A 75 to 80 weight percent yield of a 30 API gravity synthetic crude is projected. The input of steam, oxygen, and recycle gases provide necessary fluidization velocity for the sand particles inside the overall reactor means. Recycle gases thus assist in providing necessary fluidization, as well as recovering sensible heat from the hot spent sand in the moving bed portion of the reactor, and at the same time provide a further source of recoverable energy by combustion with incoming oxygen.

EXAMPLE

Particular conditions, relationships, amounts, temperatures, flow rates, sizing of reactor means, and the like, are and should be considered exemplary, and not limitative of the overall invention. The further following exemplary discussions are designed to provide a further understanding of the scope of my invention, without unduly limiting the claimable scope thereof.

On an overall basis, a tar sand composition typically involves sand of about 84 weight percent, bitumen about 13 weight percent, and water about 3 weight percent. This would be roughly equivalent to an oil shale with a Fischer assay of about 30.3 GPT. Referring to the overall process as illustrated by FIG. 1 attached, employing a raw tar sand feed of 50,000 TPCD (Tons Per Calendar Day), and a steam and oxygen feed of 1187 TPCD and 2111 TPCD per day, respectively, there would be produced a spent sand of the order of 42,000 TPCD, and a dry off-gas flow of some 2709 SCF/TTS (Standard Cubic Feet/Ton of Tar Sand). The dry off-gas would be conveyed to a gas purification or separation step, from which would be obtained an outflow of about 80 MMSCF/CD (Million Standard Cubic Feet/Calendar Day) of carbon dioxide which, if desired, can be condensed, compressed, or otherwise utilized. The gas separation step also would produce a useful gas stream of $H_2$ at a rate of about 2266 SCF/BBL of oil coming into the hydrocracker, and a $C_1$–$C_3$ content of about 262 SCF/BBL of raw oil coming into the hydrocracker.

From the reactor plant would be obtained a raw oil of about 31,821 BPCD of about 30 API. The raw oil preferably would be treated with the hydrogen fuel gas stream, in such as a hydrocracker plant, in order to upgrade the raw oil. The resulting product streams would comprise a fuel gas stream of $C_1$–$C_3$ hydrocarbons, of about a 11.11 MM SCF/CD. The other stream obtained would be a $C_4$+ oil product or synthetic crude stream at the rate of about 37,230 BPCD (Barrels Per Calendar Day) of about 40 API.

Figure 2:
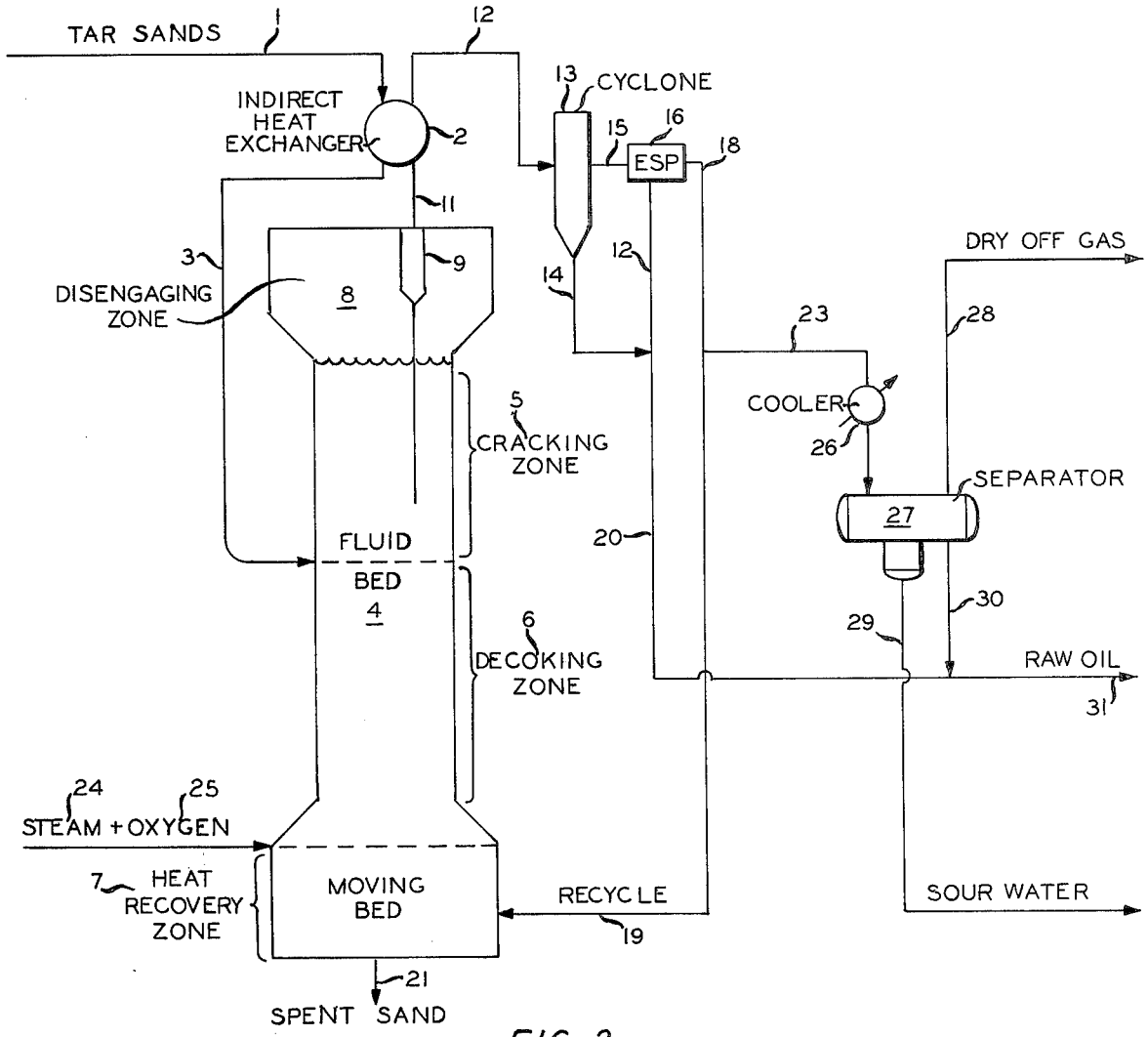
FIG. 2 represents a more detailed description of my process, again showing input of raw tar sands 1 into the centralized area of a fluidized bed reactor means 4, with steam 24 and oxygen 25 being fed into the decoking zone 6 of said fluidized bed reactor means 4. The tar sands 1 are shown preheated 3 by indirect heat exchange 2 with off-gases 11 from the reactor means 4. These cooled off-gases 12 then are taken to a separation zone such as a cyclone 13/electrostatic precipitator 16 sequence, wherein oil (raw oil) is separated 20, and the separated gases 18 then are returned in part 19 to the lower moving bed heat recovery zone 7 of the reactor means 4 where they contact hot spent sand, extracting heat from said hot spent sand, leaving a cooled spent sand 21 for disposal. The heated recycle gases then move upwardly through the coked sand 6 contacting said coked sand in conjunction with the input of the steam 24 and molecular oxygen 25 for burnoff of the coke, producing combustion gases which with the heated recycle gases and steam rise upwardly into and through the fluidized bed cracking zone 5 of the reactor means 4 to provide distillative and cracking effects for the input of tar sands 3 containing the fresh bitumen.

Referring to FIG. 2, showing in more detail the overall steps of my process, assuming a feed of 1 TPH (Ton Per Hour) of tar sands of the composition as above described at a temperature of such as about 60° F., through a preheater in heat exchange contact with the tar sand would produce a hot tar sand feed stream at such as about 447° F. which would be fed into the generally central reaction area of a fluidized bed-moving bed reactor. Typically, at this input rate and solids handling rate, such a cracking zone would have an internal diameter of about 5 square feet, wherein reaction conditions would be maintained at such as about 1,000° F. Herein, the hot bitumen is carbonized/cracked, to produce a hot off-gas stream as well as a coked hot sand. The coked hot sand moves generally downwardly, to be contacted with an input of steam coming in at such as about 300° F., for example, and oxygen. At this input of tar sand, it is estimated that an oxygen requirement of about 1,000 SCF/TTS (Ton Tar Sands) would be required, together with a steam requirement of about 1,000 SCF/TTS. This oxygen contacts the hot coked sand, burning off the hot coke, as well as combusting with any combustible materials in the recycle gases. A hot spent sand would be produced which is contacted with cool recycle gases to extract substantial amounts of the heat from the hot spent sand. This heat recovery step would result in a cooled spent sand for disposal at the rate of about 1,680 pounds per hour, and representing a heat loss of the order of about 97,440 BTU/TTS.

From the fluidized bed come hot off-gases containing a variety of hydrocarbonaceous materials as well as hydrogen, carbon dioxide, carbon monoxide, steam. This hot off-gas stream is passed in heat exchange in accordance with my optional preheating mode with incoming preheat air in order to extract and recover heat from this off-gas, as well as thusly to provide a hot air stream which then is used in indirect heat exchange with the aforesaid incoming tar sands. An air stream of about 60° F. would represent a requirement of the order of about 19,290 SCF/TTS, and would be heated to about 900° F. by the offcoming 1,000° F. hot gases, representing a heat transfer on the order of about 188,550 BTU/TTS. The heated air would be brought into indirect heat exchange with the incoming raw tar sands by means of a preheater, heating the raw tar sands to such as about 447° F., resulting in an exhaust air of the order of about 397° F. representing a loss of about 118,510 BTU/TTS.

In the presently preferred mode, the hot off-gases are employed in indirect heat exchange with the incoming cool tar sands to preheat same. The heat savings are comparable.

The hot off-gases which have come off the fluidized bed at about 1,000° F. and cooled by contact in indirect heat exchange with either air or tar sands, now have been brought down to a temperature of such as about 200° F., and are conducted to a separation zone.

A cyclone results in separation of the larger diameter mist particles that will be present in the off-gas when it is cooled to 200° F. Bottoms from the cyclone are taken into an oil product line for subsequent treatment in a hydrotreater. Gaseous materials from the cyclone preferably are treated in such as an electrostatic precipitator to remove additional hydrocarbonaceous material which can be combined to produce the raw oil for subsequent treatment in the hydrotreater.

The now deoiled cooled off-gases are recycled at least in part to the overall reactor means, contacting the hot spent sand so as to remove heat therefrom. The recycle rate would be estimated at about 11,540 SCF/TTS, at a temperature of about 220° F. going into the bottom of the reactor. The product gas can be further cooled by cooler means to such as about 50° F., subjected to a separation/condensation step so as to remove water therefrom at the rate of about 74.23 pounds per TTS, while the remaining cooled dry off-gas at the rate of about 2709 SCF/TTS is sent to the gas-purification plant. This would represent a hydrogen content estimated at about 34.77 volume percent, 40.61 $CO_2$, 18.46 CO, 6.16 $C_1$–$C_3$, at the rate of about 182.41 pounds per ton of tar sand, or 2266 SCF of $H_2$/BBL of oil going to the hydrocracker after a shiftstep in the gas purification plant.

Some oily material also is obtained from the separation step applied to the cooled recycle gases and can be combined into the raw oil stream. The result is a raw oil produced stream of about 195 pounds per hour of about 30 API material, 26.73 gallons per ton of tar sand fed. This represents an overall yield of about 75 weight percent, or 85.6 volume percent.

The raw oil preferably is conveyed to a hydrocracker wherein a hydrocracker step is applied to the raw oil in order to upgrade same. In the hydrocracker the raw tar sands oil can be hydrocracked to produce a $C_4$+ cut of naphtha at 37,230 BPCD rate. The hydrocracking can be conducted by contacting the raw oil such as described in U.S. Pat. No. 2,946,739 with hydrogen at a temperature in the range of about 750° to 850° F (400° to 455° C), a pressure in the range of about 500 to 3000 psig (3440 to 20,650 kPa), and a liquid hourly space velocity of about 0.1 to 1, using about 500 to 5000 cubic feet (14.2 to 142 cubic meters) of hydrogen per barrel (0.16 cubic meter) of oil with a suitable hydrocracking catalyst. One suitable hydrocracking catalyst contains about 0.1 to 1 weight percent rhodium, about 1 to 5 weight percent cobalt, about 3 to 10 weight percent molybdenum, and the balance an alumina catalyst support.

The treatment process results in a fuel gas $C_1$–$C_3$ production of about 11.11 MM SCF/CD, as well as a synthetic crude naphtha stream) comprising $C_4$+ hydrocarbons at the rate of about 37,231 BPCD of about 40 API gravity.

Using the amounts of materials and relationships as described for exemplary purposes, I would estimate that the reaction or cracking zone of the fluidized bed would have a cross-sectional area of about 5 square feet, the disengaging section or zone a cross-sectional area of about 10 square feet, a decoking section or zone a cross-sectional area of about 5 square feet and the spent sand heat transfer zone would have a cross-sectional area of about 9 square feet. Of course, these relationships are exemplary and not limiting since the areas can vary considerably depending on the amounts of materials to be handled, and the rising velocities employed. Respective anticipated upward velocity rates for such sizings would be of the order of about 0.5 foot per second in the spent sand heat recovery moving bed zone, about 2.24 feet per second in the fluidized decoking section, about 2.51 feet per second in the fluidized cracking zone, and about 1.26 feet per second in the disengaging section, of the reactor means. Of course, these relationships also can vary for reasons as discussed.

Thus, in accordance with my process, thermal inefficiencies of former proposed processes are solved by my design which continuously recycles heat back into the process. Both the hot spend sand and the hot reactor off-gases are subjected to heat exchange which retrieves and returns otherwise escaping heat back into the process. The extent to which this is accomplished can have a dramatic effect on the efficiencies of the overall process. Furthermore, my process wherein the raw tar sand is fed somewhat below the surface of the fluidized bed is such that the hottest sand is located in the decoking section of the fluidized bed portion of the reactor. Also, steam and oxygen are used as the retorting means, contacting the coked sand, burning off the coke, and providing a proper reducing atmosphere wherein to crack the heavy thermal decomposition products of the bitumen. Because of the feed location and amounts fed, because of the temperatures maintained in the bed, the input oxygen reacts almost instantaneously with the coke deposited on the sand, as well as combustible materials contained in the recycle gas, which resulting hot gases not only retort the fresh bitumen in a reducing atmosphere rather than an undesirable oxidizing atmosphere, but the steam obtained from the raw tar sands and the steam fed to the process result in a large volume of steam existing in the retorting gas, such that the thermal decomposition of the bitumen is carried out in the presence of water, with a hot reducing gas supplying the heat, and in the presence of a solid sand surface downstream of the point of the introduction of the raw bitumen.

As is apparent from an inspection of my system, there are two sets of process requirements to be satisfied substantially simultaneously: the fluidization requirements, and the chemical requirements. Bringing the gas flows up to fluidization velocities requires recycle of gaseous products in accordance with my process, which recycle also is used to recover sensible heat from the hot spent sand in the moving bed portion of the reactor means.

The disclosure, including data, has illustrated the value and effectiveness of my invention. The exemplary data presented, as well as the knowledge and background of the field of the invention, and of general principles of the petroleum and other applicable sciences, have formed the bases from which the broad descriptions of my invention including the ranges of conditions have been developed, and have formed the bases for my claims here appended.

I claim:

1. A process for producing a raw oil from a tar sand containing bitumen, which comprises the steps of:

(a) preheating a tar sand containing bitumen by indirect heat exchange with hot off-gas stream as hereinafter recited in step (f).

(b) feeding said preheated tar sand from said step (a) containing bitumen into a fluidized bed of tar sands wherein said fluidized bed of tar sands comprises a contiguous upper cracking zone, an intermediate decoking zone, and a lower heat recovery zone, (c) converting said tar sand containing bitumen in said upper cracking zone of said fluidized bed at effective temperatures, pressures, and velocities of said fluidized bed in a substantially reducing atmosphere into a coked sand and a vaporous off-gas, wherein said substantial reducing atmosphere comprises steam, combustion gases, and recycle gases, and said vaporous off-gas comprises said reducing atmosphere, hydrocarbonaceous material, and hydrogen, (d) decoking said coked sand in said intermediate decoking zone of said fluidized bed with steam and oxygen in the presence of recycle gases, at effective temperatures, pressures and velocities, producing a hot spent sand, and said reducing atmosphere, (e) disengaging said vaporous hot off-gas stream from said coked sand, (f) preheating said tar sand containing bitumen in said step (a) by indirect heat exchange with said hot off-gas stream, and thereby at least partially cooling said off-gas stream, (g) separating said at least partially cooled off-gas stream into streams comprising a raw oil stream and a recycle gas stream, (b) passing at least a portion of said recycle gas stream into said heat recovery zone to contact said hot spent sand at effective velocities, thereby producing a cooled spent sand, and a heated recycle gas stream, and (i) passing said heated recycle gas stream upwardly through said decoking zone and thence into said cracking zone as a portion of said reducing atmosphere therein.

2. The process of claim 1 further comprising (j)

hydrocracking said raw oil under hydrocracking conditions, thereby producing a synthetic oil.

3. The process of claim 1 further comprising contacting in indirect heat exchange said hot off-gas stream from said step (e) with a stream of air, thereby producing said at least partially cooled off-gas stream, and a hot air stream, and passing said hot air stream into indirect heat exchange with said raw tar sand containing bitumen, thereby resulting in a cooled exhaust air stream, and preheating said tar sand containing bitumen.

4. The process according to claim 2 wherein said step (g) comprises demisting said cooled off-gas stream to recover oily materials, and produce a deoiled gas stream comprising steam, low molecular weight hydrocarbonaceous materials, hydrogen, carbon dioxide, and carbon monoxide, cooling said deoiled gas stream to recover a stream of sour water, a stream of dry gases, wherein said dry gases comprise hydrogen, carbon dioxide, carbon monoxide, and $C_1$ to $C_3$ hydrocarbons, converting said carbon monoxide by the water-gas reaction to produce additional hydrogen and carbon dioxide, separating out said carbon dioxide, leaving a stream of hydrogen and $C_1$ to $C_3$ hydrocarbons, hydrocracking said raw oil in the presence of said $C_1$ to $C_3$ hydrocarbons and hydrogen under hydrocracking conditions, thereby producing a fuel gas of $C_1$ to $C_3$ composition, and a synthetic oil product of $C_4+$ character.

5. The process according to claim 4 wherein said carbon dioxide is separated by scrubbing said dried off-gases with an amine or glycol.

6. The process according to claim 2 wherein said step (g) comprises demisting said cooled off-gas stream to recover oily materials, and produce a deoiled gas stream comprising steam, low molecular weight hydrocarbonaceous materials, hydrogen, carbon dioxide, and carbon monoxide, cooling said deoiled gas stream to recover a stream of sour water, a stream of dry gases, and wherein said dry gases comprise hydrogen, carbon dioxide, carbon monoxide, and $C_1$ to $C_3$ hydrocarbons, separating said $C_1$ to $C_3$ hydrocarbon and hydrogen stream to produce a hydrogen stream and a $C_1$ to $C_3$ hydrocarbon first stream, hydrocracking said hydrogen in a hydrocracking step with said raw oil, thereby producing a synthetic oil of $C_4+$ character, and a second stream of $C_1$ to $C_3$ hydrocarbons, and wherein said first and second streams of $C_1$ to $C_3$ hydrocarbons are subsequently combined.

7. The process according to claim 2 wherein said hydrocracking step conditions include contacting temperatures in the range of about 750° F. to 850° F., a pressure in the range of about 500 to 3,000 psig, and employs a liquid hourly space velocity of about 0.1 to 1, using about 500 to 5,000 cubic feet of hydrogen per barrel of raw oil, and further employs a cracking catalyst.

8. The process according to claim 7 wherein said cracking catalyst contains about 0.1 to 1 weight percent rhodium, about 1 to 5 weight percent cobalt, and about 3 to 10 weight percent molybdenum, on an alumina support.

9. A process according to claim 1 employing for a feed of about 1 TPH tar sand with bitumen, a cracking zone cross-sectional area of about 5 square feet, a decoking zone cross-sectional area of about 9 square feet, a heat recovery zone cross-sectional area of about 9 square feet, an upward velocity rate of the order of about 1 foot per second in said converting step (c), about 2.24 feet per second in said decoking step (d), about 2.51 feet per second in said converting step (c), and about 1.26 feet per second in said disengaging step (e).

10. The process according to claim 9 employing a recycle rate of about 11,540 SCF/TTS at a temperature of said recycle gases of about 220° F. going into said heat recovery zone.

* * * * *